US011541300B2

(12) United States Patent
Funke

(10) Patent No.: US 11,541,300 B2
(45) Date of Patent: Jan. 3, 2023

(54) APPARATUS AND METHOD FOR PREVENTING BALL RETURN STOPS IN BOWLING PINSETTER MACHINES

(71) Applicant: Edward Funke, Las Vegas, NV (US)

(72) Inventor: Edward Funke, Las Vegas, NV (US)

( * ) Notice: Subject to any disclaimer, the term of this patent is extended or adjusted under 35 U.S.C. 154(b) by 0 days.

(21) Appl. No.: 17/180,138

(22) Filed: Feb. 19, 2021

(65) Prior Publication Data

US 2021/0283492 A1 Sep. 16, 2021

Related U.S. Application Data

(60) Provisional application No. 62/985,743, filed on Mar. 5, 2020.

(51) Int. Cl.
*A63D 5/08* (2006.01)

(52) U.S. Cl.
CPC ..... *A63D 5/08* (2013.01)

(58) Field of Classification Search
CPC ..... A63D 5/08
See application file for complete search history.

(56) References Cited

U.S. PATENT DOCUMENTS 2,978,247 A * 4/1961 Mitchell ..... A63D 5/02 473/64
5,391,116 A * 2/1995 Burkholder ..... A63D 5/08 473/96

OTHER PUBLICATIONS

Tongue and Groove Joint, Science Direct, Ridid Intergral Mechanical Attachments or Interlocks, https://www.sciencedirect.com/topics/engineering/tongue-and-groove-joint, Robert W. MesslerJr., in Integral Mechanical Attachment, Dec. 2006.*

* cited by examiner

*Primary Examiner* — William M Pierce
(74) *Attorney, Agent, or Firm* — The Thornton Firm, LLC

(57) ABSTRACT

A system for preventing ball return stops in automatic pinsetter machines includes a substantially wedge-shaped solid body mounted in a specific location along a transport band of an automatic pinsetter machine. The solid body is shaped, configured, and made of a material conducive to deflecting bowling pins away from a ball return door as bowling pins travel on a transport band towards a pin elevator. A method for preventing ball return stops in automatic pinsetter machines using an apparatus for preventing ball return stops in automatic pinsetter includes the steps of configuring the said apparatus for preventing ball return stops in automatic pinsetter machines, selecting an optimal location to mount the said apparatus for preventing ball return stops in automatic pinsetter machines, and mounting the said apparatus for preventing ball return stops in automatic pinsetter machines.

8 Claims, 5 Drawing Sheets

APPARATUS AND METHOD FOR PREVENTING BALL RETURN STOPS IN BOWLING PINSETTER MACHINES

CROSS-REFERENCE TO RELATED APPLICATIONS

The present utility patent application claims priority benefit of the U.S. provisional application for patent Ser. No. 62/985,743 titled "Apparatus and Method For Preventing Ball Return Stops In Bowling Pinsetter Machines," filed on Mar. 5, 2020 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

BACKGROUND OF THE INVENTION

1. Field of the Invention

The invention relates generally to bowling pinsetter machines. More specifically, the invention relates to an apparatus and method for preventing ball return stops or jams in automatic pinsetter machines.

2. Description of the Related Art

Hundreds of millions of people enjoy bowling. Bowling is a popular recreational activity in the United States and abroad. In bowling, the object of the game is to throw or roll a bowling ball towards a set of pins. Modern bowling involves rolling a large, relatively heavy, ball towards a set of ten pins with the goal of knocking as many pins down as possible.

Bowling alleys generally comprise a plurality of even and odd numbered bowling lanes. In modern bowling, mechanical pinsetters are used in place of human labor. A modern pinsetter is a machine that sets bowling pins back to their original position, returns bowling balls back to the front of the alley, and clears fallen pins on the pin deck. A typical bowling pinsetter consists of a number of electrical and mechanical components which generally include a sweep bar, a table, a pit, a pin elevator, and a ball return. Even and odd numbered lanes generally share the same ball return.

The sweep bar removes fallen and leftover pins from the bowling lane or pin deck. In most pinsetters, the sweep bar is triggered as soon as the ball enters the pit, usually via an optical sensor that detects the ball motion as it passes a certain point as it travels to the end of a bowling lane. The sweep bar cycles back to its original position after clearing a bowling lane.

The table is a device which lifts the remaining standing pins for the sweep bar to remove fallen pins from the lane or pin deck. The table further places pins onto the lane or pin deck for the bowler's next roll.

The pit is collection area behind the lane where bowling balls and struck pins are collected for sorting. The pit is generally positioned below the end of a bowling lane, and includes a means for separating the pins from the bowling ball. In one of the most popular pinsetter machines, a transport band is employed. Other band and shaker mechanisms may be used in different pinsetter machines. A transport band is a specially designed conveyor belt positioned at a special angle which moves the pins and ball to the rear of the pit. When a bowling ball enters the pit, it is slowed by a ball cushion board and is guided towards a ball return door while pins move under the ball cushion board.

The pin elevator brings pins upwards out of a bowling lane's pit to the top of the unit for re-setting for successive frames, usually in the form of a vertically-oriented toroid-shape system at the extreme rear of the pinspotter for tenpin bowling units, to deliver pins upwards from the pit into the pin storage system. Typical pinsetters employ a system of pin storage for storing the next full "rack" of pins after delivery to it by the pin elevator system. Stored pins are ultimately moved to the table and lowered to the lane or pin deck.

The ball return removes the bowler's ball from the bowling lane's pit and sends it rolling back to the bowler through the use of a ball accelerator and a ball return track. A typical ball return is located between paired bowling lanes, and runs from the pit component of a pinsetter to the ball rack located in the bowler's area. The ball return track is normally located below the lane. The ball return's components are designed to receive a bowling ball which is separated from the fallen pins in the pit. with the goal of not allowing pins to enter the ball return track, or block the ball door from the front or back in the pit area.

One of the most widely used pinsetter machines is the Brunswick® GS-X pinsetter. Created and developed in the late 1980s, this machine has become an industry standard over the course of three decades. The GS-X pinsetter pit area includes a transport band, a pin elevator and a ball accelerator assembly including a ball door which is designed to separate knocked-down pins from a bowling ball after a bowling ball and pins enter the pit area. When a bowling ball strikes bowling pins, it concurrently rolls past an optical sensor which triggers the ball sweep and locks the ball door through the use of a ball door solenoid. After moving past the pin sweep, the bowling ball enters the pit where it is slowed by a ball cushion board and is guided towards the ball door while the pins move along the moving transport band under the ball cushion board and towards the pin elevator and ultimately back to the table. The ball door is held shut for three seconds which allows the ball to ultimately roll towards the ball door while the pins roll towards the pin elevator. The ball door then opens and the ball rolls through the ball door and into the ball accelerator and back to the bowler. Attached to one end of the ball cushion are cushion flaps which serve as a mechanism to prevent bowling pins from rolling in the opposite direction of the transport band and into the ball door.

In spite of numerous technological advancements, bowling pins still manage to enter ball doors or block entry to the ball door. Bowling pins travel along a transport band in very unique ways as a result of their unique shape and because of the momentum they carry when entering the pit after being either struck or swept. Bowling pins may roll, spin or even pile up on one another depending on the number of pins in a given area and the initial dynamic properties with which each pin enters the pit. Put simply, bowling pins may move in all directions while traveling along a transport band and sometimes enter the ball door or block it when the ball door is open. When pins enter an open ball door, they cause jams in the ball return mechanism. Such instances are known in the art as ball return stops. In the Brunswick® GS-X pinsetter, ball return stops are one of the most troublesome problems encountered by technicians and bowlers alike.

Correcting a ball return stop can be both time consuming and hazardous. A technician must stop the pinsetter machine, insure that the sweep bar is in the down position to prevent bowling balls from entering the pinsetter, turn off the main power switch, open the ball return rear door to gain access to the ball return area, check for pins blocking the ball door opening, check for pins inside the ball the accelerator, verify the operability of the ball door locking assembly, check the ball return area for other objects in the ball return, close the ball return rear door, and then finally restart the pinsetter. Such a process puts technicians in harm's way. Moreover, clearing ball return stops makes for an unpleasant experience for bowlers.

Numerous attempts have been made to reduce the number of ball return stops in pinsetter machines, namely the Brunswick® GS-X. Such attempts include adjusting the angle of the transport band, changing ball door spring tension, improving ball cushion flaps, and ball door lock adjustments. However, to date, none have been truly successful.

Presently, there exists a need for an apparatus, system and method for preventing ball return stops in bowling pinsetter machines. Such an apparatus and method must be able to facilitate the clearing of the pit area of bowling pins without causing damage to bowling balls, pins and the pinsetter machine.

SUMMARY

The present invention fulfils the long-felt need for an improved apparatus and method for preventing ball return stops in bowling pinsetter machines. At its essence, the invention comprises an installable apparatus for deflecting bowling pins away from a ball door. The invention further discloses a method for preventing ball return stops comprising the steps of installing an apparatus into an existing pinsetter machine.

An object of the invention is prevent ball return stops by clearing and deflecting pins away from the ball door while travelling along a transport band.

Another object of the invention is to prevent ball return stops by preventing bowling pins from entering the ball door or blocking the ball door from either the front or back side as pins travel down the transport band.

A further object of the invention is to keep a pinsetter running efficiently by facilitating the transport of bowling pins along a transport band towards the pin elevator.

The ultimate object of the invention is to provide a better experience for bowlers by reducing or eliminating the problem of ball return stops.

In embodiments of the invention, the apparatus and method for preventing ball return stops in automatic pinsetter machines involves the use of a substantially wedge-shaped solid body which is mounted on the ball accelerator box slightly above the transport band. The angle and material of the block can vary; but in the preferred embodiments of the invention the substantially wedge-shaped solid body has an angle of 45 degrees.

The present invention is further directed to a system for preventing ball return stops in automatic pinsetter machines comprising a substantially wedge-shaped solid body mounted in a specific location along a transport band of an automatic pinsetter machine, the said substantially wedge-shaped solid body anchored in said specific location along said transport band of an automatic pinsetter machine, and the said substantially wedge-shaped solid body positioned in a specific location along a transport band of an automatic pinsetter machine being shaped and configured to deflect bowling pins away from a ball return door as said bowling pins travel towards a pin elevator. Such a system has been demonstrated to substantially reduce ball return stops in automatic pinsetter machines.

The present invention is further directed to a method for preventing ball return stops in automatic pinsetter machines using an apparatus for preventing ball return stops in automatic pinsetter includes the steps of configuring the said apparatus for preventing ball return stops in automatic pinsetter machines, selecting an optimal location to mount the said apparatus for preventing ball return stops in automatic pinsetter machines, and mounting the said apparatus for preventing ball return stops in automatic pinsetter machines. Such a method can significantly reduce ball return stops in automatic pinsetter machines which utilize a pit area where bowling pins and the bowling ball are carried towards the rear of the pit area by a transport band to a pin elevator where pins are transported above a bowling pinsetter and moved into a table and lowered on a pin deck.

The wedge-shaped solid body effectively deflects bowling pins away from the ball door and directs bowling pins towards the pin elevator. The apparatus is designed to be used on both even and odd numbered lanes. The use of such a device has produced new and unexpected results, namely a 50-75% reduction of all ball return stops and the facilitation of pin travel towards the pin elevator since the apparatus and method has been implemented at a test facility. Moreover, use of such an apparatus can extend the lifespan of automatic pinsetter machines by reducing everyday wear and tear in the pit area.

BRIEF DESCRIPTION OF THE DRAWINGS

The invention directed by way of example, and not by way of limitation, in the figures of the accompanying drawings and in which like reference numerals refer to similar elements and in which.

Figure 1:
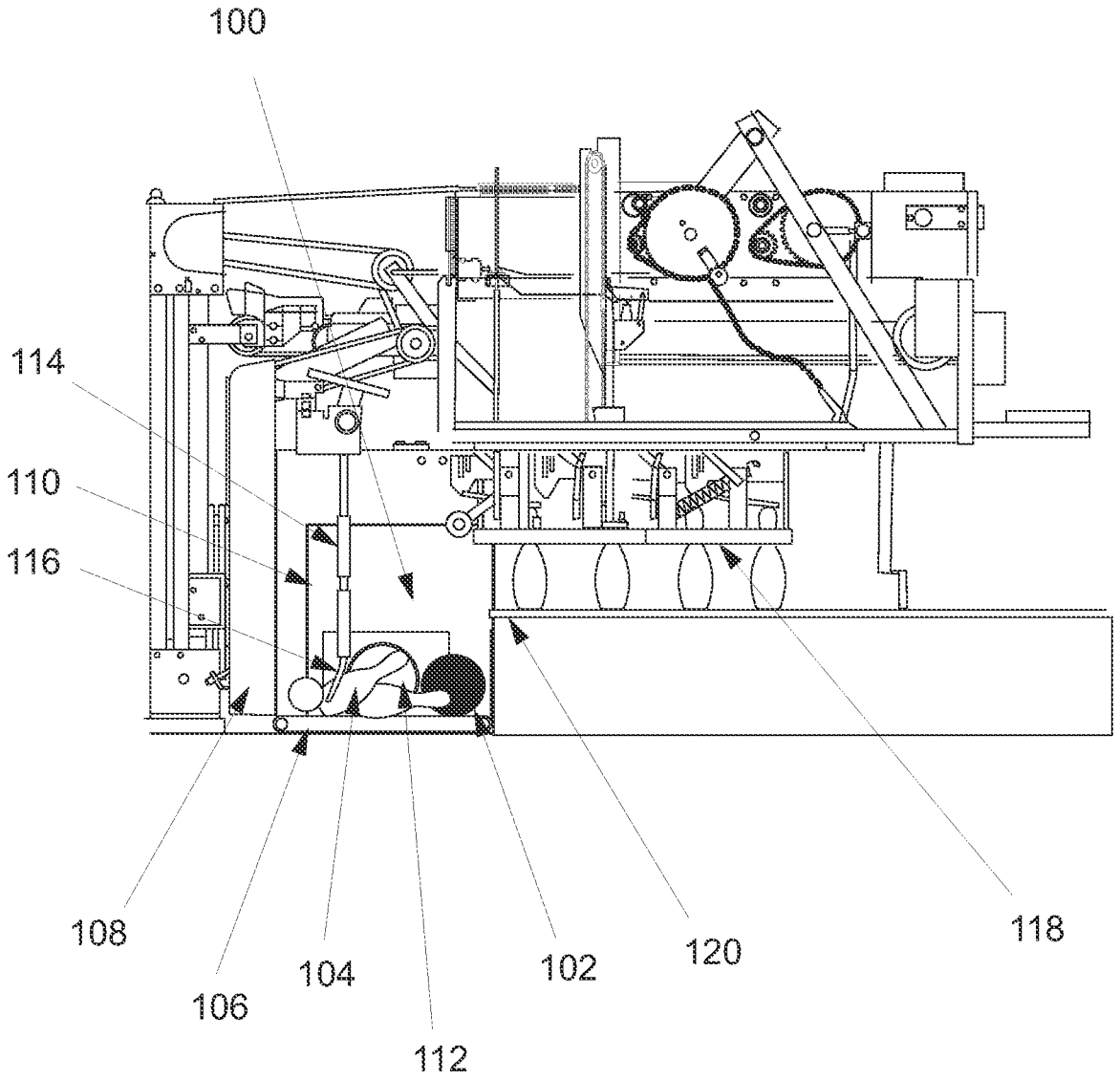
FIG. 1 is a side view of a bowling pinsetter including the pit area.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

References to "one embodiment," "one variant," "an embodiment," "a variant," "various embodiments," "numerous variants," etc., may indicate that the embodiment(s) of the invention so described may include particular features, structures, or characteristics. However, not every embodiment or variant necessarily includes the particular features, structures, or characteristics. Further, repeated use of the phrase "in one embodiment," or "in an exemplary embodiment," or "a variant," or "another variant," do not necessarily refer to the same embodiment although they may. A description of an embodiment with several components in communication with each other does not imply that all such components are required. On the contrary, a variety of optional components are described to illustrate the wide variety of possible embodiments and/or variants of the present invention.

As is well known to those skilled in the art, many careful considerations and compromises typically must be made when designing the optimal manufacture or commercial implementation of such a apparatus and method for preventing ball return stops in bowling pinsetter machines. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

The exemplary apparatus and method for preventing ball return stops in bowling pinsetter machines will now be described in detail with reference to embodiments thereof as illustrated in the accompanying drawings.

FIG. 1 is a side view of a bowling pinsetter including the pit area 100. In this particular illustration, the Brunswick® GS-X model is depicted. However, it will become readily apparent to persons having skill in the art that other models of similar make may also employ the same or similar mechanism. In this view, a bowling ball 102 and bowling pins 104 are collected in the pit area 100. Bowling pins 104 and the bowling ball 102 are carried towards the rear of the pit area 100 by a transport band 106. At the rear of the pit area is a pin elevator 108 where pins are transported above a bowling pinsetter and moved into a table 118 and lowered on a pin deck 120.

A bowling ball is diverted towards a ball accelerator housing 110 and travels towards, and ultimately travels through, a ball door 112 by a ball cushion 114. The bowling ball is then returned to a bowler. Attached to one end of the ball cushion 114 are cushion flaps 116 which serve as a mechanism to prevent bowling pins from rolling in the opposite direction of the transport band and into the ball door. As is understood in the prior art, the ball cushion 114 and cushion flaps 116 are the primary components used to prevent bowling pins from entering the ball door and causing ball return stops.

Figure 2:
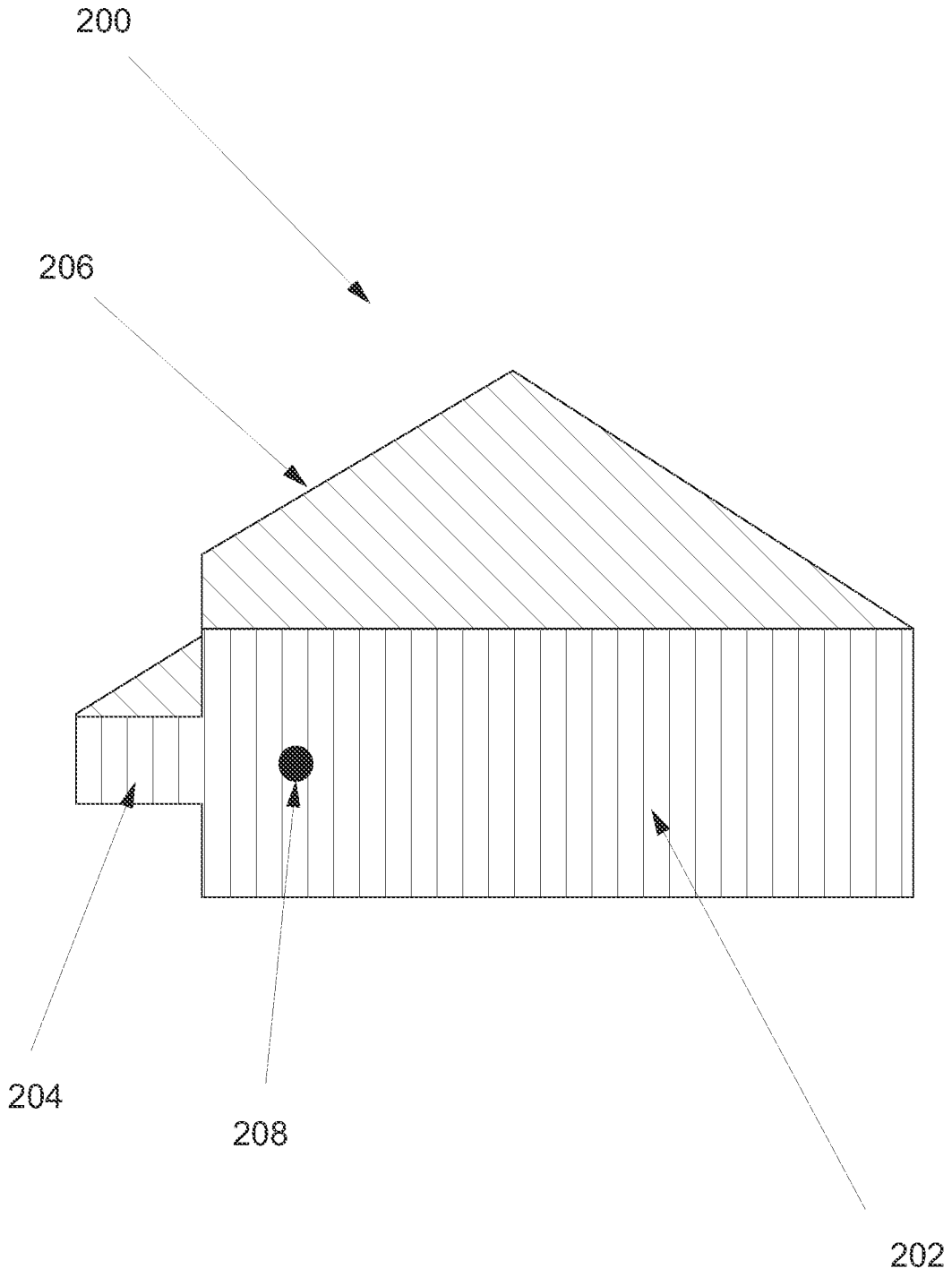
FIG. 2 is a perspective view of an apparatus for preventing ball return stops in accordance with an embodiment of the invention.

FIG. 2 is a perspective view of an apparatus for preventing ball return stops in bowling pinsetter machines 200 in accordance with an embodiment of the invention. In the preferred embodiment of the invention, the apparatus for preventing ball return stops in pinsetter machines 200 can assume a substantially wedge-shaped appearance. The apparatus includes an angled surface 202, a tongue 204 and a mounting surface 206. In the preferred embodiment of the invention, the angle for creating the angled surface is forty-five degrees. The mounting surface 206 mates with the surface of the ball accelerator housing. A tongue 204 can also be included so as to fit in a groove prepared in or on the mounting surface 206. One or more screw holes 208 can be positioned in numerous positions and angles in the apparatus. Persons having skill in the art will understand that optimal placement of screw holes and mounting bolts can vary depending on need, and that screw holes can be pre-manufactured or can be fashioned locally by skilled artisans. In various embodiments of the invention, the apparatus is secured to a bowling pinsetter machine by one or more screws or bolts secured by nuts or screw threads. Moreover, persons having skill in the art will appreciate that the one or more screws can be countersank and secured by lock washers.

The apparatus can be mounted to a pinsetter machine by inserting the tongue into a prepared groove and securing the wedge-shaped solid body to the automatic pinsetter machine with one or more nuts and bolts. Persons skilled in the art will readily appreciate that the tongue 204 may be shaped in numerous configurations to mate with indentations or grooves in the ball accelerator housing or ball door assembly. In alternative embodiments of the invention, a tongue is not required. In other embodiments of the invention, the apparatus can be mounted with an adhesive. In further embodiments of the invention, the apparatus can be chemically welded to any suitable surface. In embodiments of the invention, the apparatus 200 can be made from a hard wood such as hickory, a wood laminate, metal, rubber, composite material, or a plastic. Persons skilled in the art will readily appreciate that the desired material is to be strong and dense enough to withstand repeated impacts from bowling pins and bowling balls when used in an automatic pinsetter machine.

Persons skilled in the art will readily appreciate that differing adaptations and variants may be implemented from this basic design. By way of example, and not limitation, the invention is directed to a simple mechanical angled device. However, other implementations of the invention may extend to electro-mechanical devices which may integrate into the hardware and software of contemporary pinsetter machines such as, but not limited to, the Brunswick® GS X pinsetter. Such electro-mechanical devices may include linear actuators and electronic solenoids which can be used to extend a divertor from the ball accelerator housing into the pit area parallel to the surface of the transport band. Moreover, embodiments of the invention can be configured to include sensors and sensor arrays capable of monitoring activity in the pit area.

Figure 3:
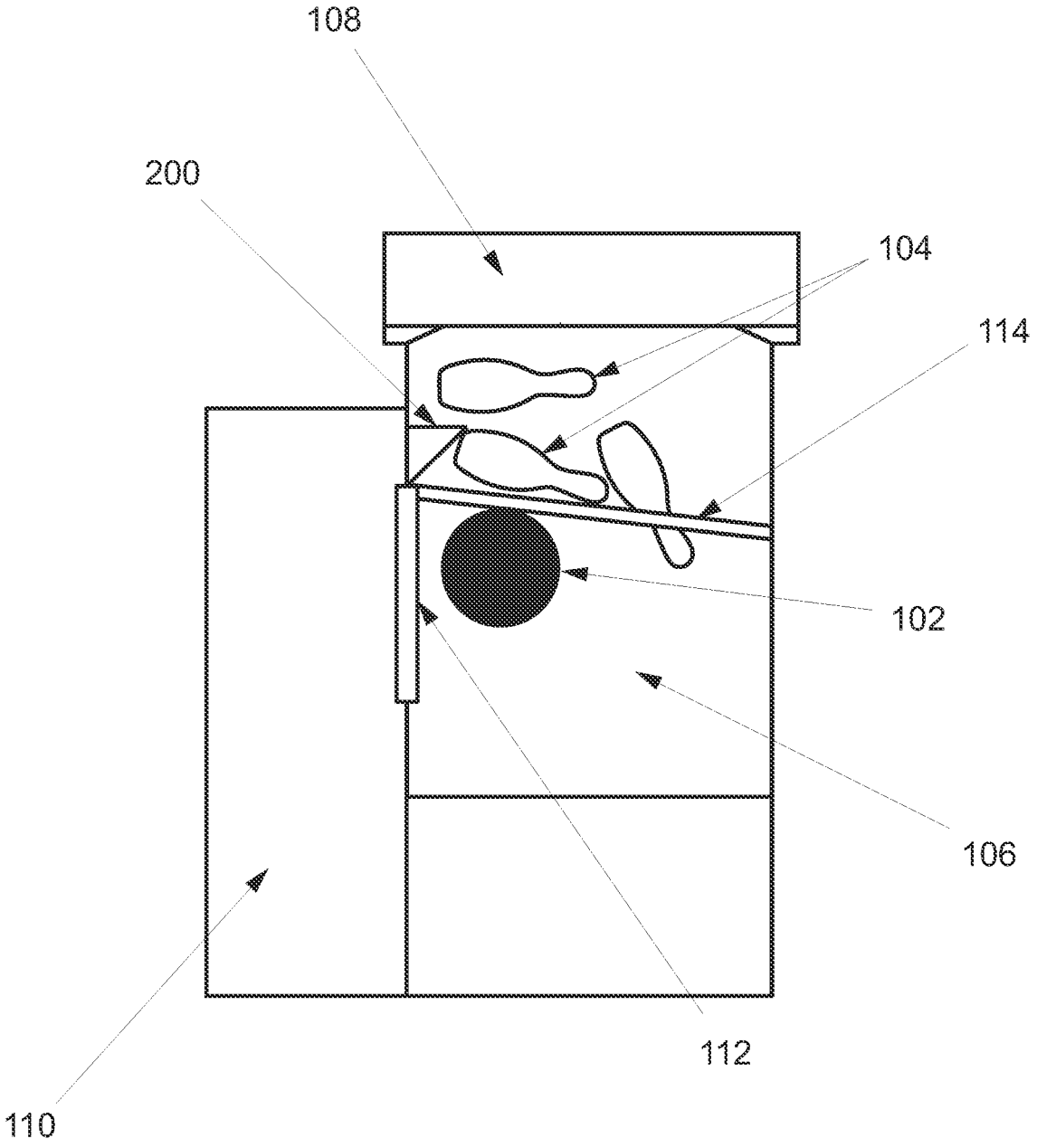
FIG. 3 is a top view of a pin deck and pit area employing an apparatus for preventing ball return stops in accordance with an embodiment of the invention.

FIG. 3 is a top view of a pin deck and pit area employing an apparatus for preventing ball return stops in accordance with an embodiment of the invention. In this view, objects are not drawn to scale, and may be positioned differently depending on the pinsetter type. Persons skilled in the art will readily appreciate that different configurations and sized components may be employed in various bowling pinsetter machines, and that this basic representation may serve as a general guide.

At its essence, the apparatus for preventing ball return stops in bowling pinsetter machines 200 comprises an installable apparatus 200 for deflecting bowling pins 104 away from a ball door as the pins are moved by a transport band 106 towards a pin elevator 108. The apparatus 200 deflects bowling pins towards the center of the transport band as they move towards the pin elevator and prevent bowling pins from rolling backwards towards the ball door 112. The ball cushion 114 guides the bowling ball 102 towards the ball door while bowling pins travel underneath the cushion 114. Such a ball cushion 114 is slightly angled so as to facilitate movement of the bowling ball towards the ball door 112.

Bowling pins travel along a transport band in very unique ways as a result of their unique shape and because of the momentum they carry when entering the pit after being either struck or swept. A typical bowling pin generally weighs between 3 pounds, six ounces to 3 pounds, ten ounces, or between 1.5 and 1.6 kilograms. Bowling pins are roughly 4.75 inches wide at their widest point and are 15 inches tall. Bowling pins may roll, spin or even pile up on one another depending on the number of pins in a given area and the initial dynamic properties with which each pin enters the pit. It is therefore desired to have a device which deflects bowling pins towards the pin elevator and prevents bowling pins from rolling in an opposite direction as the transport band so as to enter the ball door.

In the preferred embodiment of the invention, the apparatus 200 is positioned roughly one third the distance from the pin elevator 108 and two thirds the distance from the end of the transport band 106 closest to the pin deck 120. However, persons having skill in the art will readily appreciate that the apparatus 200 can be positioned in other suitable locations based on factors such as equipment location and transport band 106 length. In a bolt-on embodiment of the invention, two holes are drilled into the ball accelerator housing where two machine screws are threaded through the holes. The screws may accommodate lock washers and a standard hex bolt which may connect the apparatus to the ball accelerator housing. In alternative embodiments of the invention, the apparatus may be attached by other means such as, but not limited to, rivets, welds, adhesives or other combinations of mechanical bolt and nut mechanisms. It will be readily understood by persons skilled in the art that measurement and position distances may be adjusted depending on factors such as, but not limited to, transport band length, pit area, ball accelerator housing dimensions and pin elevator position. Persons skilled in the art will readily appreciate that the dimensions of the apparatus 200 may assume multiple dimensions, angles and mounting means.

Figure 4:
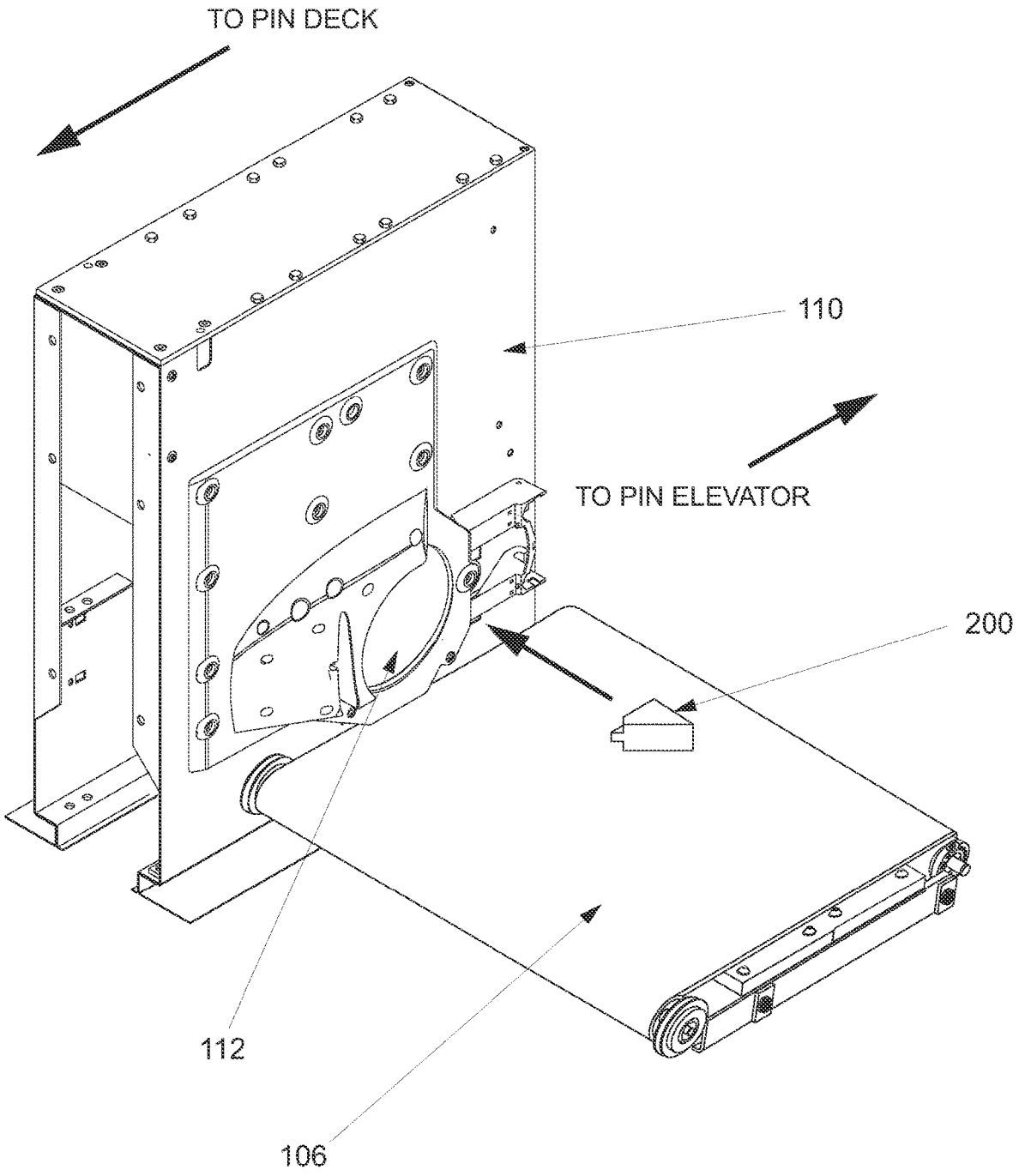
FIG. 4 is a is a perspective view of a transport band and ball accelerator housing and an apparatus for preventing ball return stops in bowling pinsetter machines.

FIG. 4 is a perspective view of a transport band and ball accelerator housing and an apparatus for preventing ball return stops in bowling pinsetter machines 200. In this view, the apparatus for preventing ball return stops in bowling pinsetter machines attaches to the ball accelerator housing 110 laterally and downward along the transport band from the ball door 112, towards the pin elevator and slightly above the transport band 106. Persons having skill in the art will understand that the term "along" generally relates to the direction of the transport band's travel path. In one embodiment of the invention, the apparatus is mounted two millimeters above the transport band. However, persons skilled in the art will readily appreciate that "slightly above" the transport band can be any measurement used so as to not frictionally engage with a moving transport band, thus causing damage to the transport band. In this view, the ball cushion is not pictured so as to provide a better view of the ball accelerator housing, ball door and transport band. Arrows depict the direction towards the pin elevator and pin deck respectively. Arrows further depict the general positioning of the apparatus for preventing ball return stops in bowling pinsetter machines 200. In this view, the apparatus 200 is configured to attach to the ball accelerator housing and ball door assembly.

Figure 5:
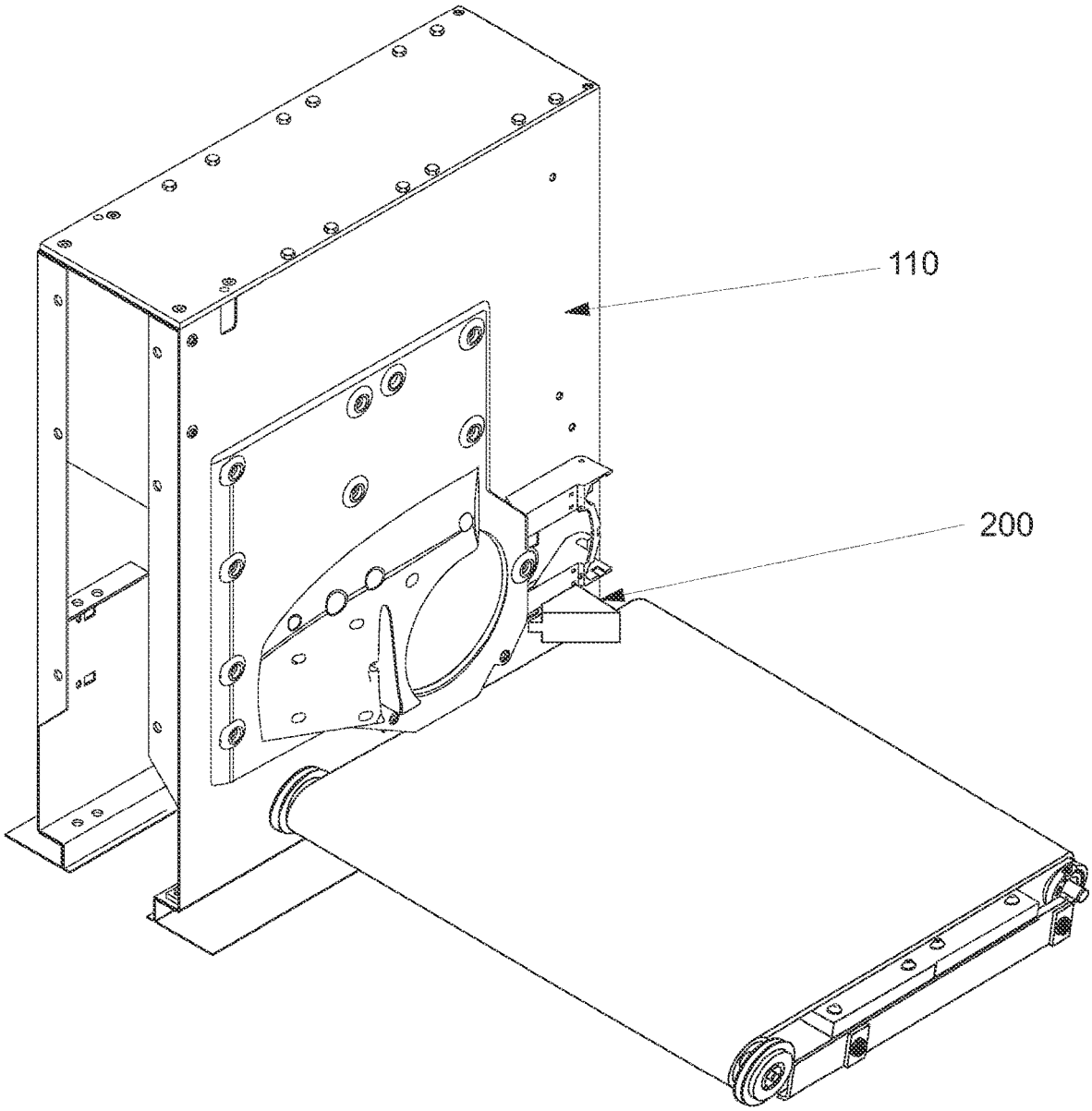
FIG. 5 is a perspective view of a transport band and ball accelerator housing employing the apparatus for preventing ball return stops in accordance with an embodiment of the invention.

FIG. 5 is a perspective view of a transport band and ball accelerator housing employing the apparatus for preventing ball return stops in accordance with an embodiment of the invention. In this view, the apparatus for preventing ball return stops in bowling pinsetter machines attaches to the ball accelerator housing behind the ball door and slightly above the transport band. In alternative embodiments of the invention, the apparatus for preventing ball return stops in automatic bowling pinsetter machines can be attached to any suitable surface so as to deflect pins away from a ball door. In this view, the ball cushion is not pictured so as to provide a better view of the ball accelerator housing, ball door and transport band. In various embodiments of the invention, the apparatus for preventing ball return stops in bowling pinsetter machines 200 is attached to the ball accelerator housing in a position slightly rearward of the ball door and slightly above the transport band. In the preferred embodiment, the apparatus 200 is mounted so as to create a one-half inch space between the transport band surface and the bottom of the apparatus. In alternative embodiments, the space and positioning of the apparatus may vary.

A method for preventing ball return stops in automatic pinsetter machines involves creating an angled block of a solid material and mounting the angled block of a solid material on the ball accelerator box slightly above the transport band. It will become readily apparent to persons skilled in the art that "slightly above" the transport band can be any measurement used so as to not frictionally engage with a moving transport band, thus causing damage to the transport band. In the preferred embodiment of the invention, a 3.5-inch by 3.5-inch block is shaped into a right-angled apparatus. In alternative embodiments, the angle and material of the block may vary; but in the preferred embodiment of the invention employs a wooden block having an angle of 45 degrees. The apparatus is then attached to the ball accelerator housing using standard machine screws and a combination of nuts and washers known and understood in the art. Persons skilled in the art will readily appreciate that the apparatus may be attached through numerous means such as, but not limited to, rivets, welds, adhesives or other combinations of mechanical bolt and nut mechanisms.

Tests and reproducible data have shown that use of the apparatus for preventing ball return stops in bowling pinsetter machines can reduce ball return stops up to ninety percent. In certain pinsetter machines which can utilize over twenty pins, the apparatus for preventing ball return stops has proven to dramatically reduce ball return stops where more than ten pins (typically used in modern bowling games) have been introduced into a pit area. The apparatus for preventing ball return stops in bowling pinsetter machines can also significantly reduce wear and tear in the pit area.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the apparatus and method for preventing ball return stops in bowling pinsetter machines, other equivalent or alternative methods of implementing the apparatus and method for preventing ball return stops in bowling pinsetter machines according to the present invention will be apparent to those skilled in the art. Various aspects of the invention have been described above by way of illustration, and the specific embodiments disclosed are not intended to limit the invention to the particular forms disclosed. The particular implementation of the apparatus and method for preventing ball return stops in bowling pinsetter machines may vary depending upon the particular context or application. By way of example, and not limitation, the apparatus and method for preventing ball return stops in bowling pinsetter machines described in the foregoing was principally directed to Brunswick® GS X pinsetter machines. However, similar techniques may instead be applied to other pinsetter machines which implementations of the present invention are contemplated as within the scope of the present invention. Furthermore, implementations of the invention may extend to electro-mechanical devices which may integrate into the hardware and software of contemporary pinsetter machines such as, but not limited to, the Brunswick® GS X pinsetter. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of the apparatus and method for preventing ball return stops in bowling pinsetter machines are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively, and are not limited to any physical interconnection. Claim elements and steps herein may have been numbered and/or lettered solely as an aid in readability and understanding. Any such numbering and lettering in itself is not intended to and should not be taken to indicate the ordering of elements and/or steps in the claims to be added at a later date.

Any amendment presented during the prosecution of the application for this patent is not a disclaimer of any claim element presented in the description or claims to be filed. Persons skilled in the art cannot reasonably be expected to draft a claim that would literally encompass each and every equivalent.

What is claimed is:

1. A system for preventing ball return stops in automatic pinsetter machines comprising a pit area including a ball door, a transport band, a pin elevator, a ball cushion, and:

a. a substantially wedge-shaped solid body shaped and configured to deflect bowling pins away from a ball return door as said bowling pins travel along a transport band and towards a pin elevator;

b. said substantially wedge-shaped solid body mounted to a specific location along a transport band; and c. said substantially wedge-shaped solid body mounted in a specific location along a transport band of an automatic pinsetter machine along a transport band between a ball door and a pin elevator and configured to deflect bowling pins away from a ball door as bowling pins travel towards a pin elevator.

2. The system of claim 1 wherein the substantially wedge-shaped body is made from an impact resistant plastic.

3. The system of claim 1 wherein the substantially wedge-shaped body is made from an impact resistant wood.

4. The system of claim 1 wherein the substantially wedge-shaped solid body is mountable to an automatic pinsetter machine by securing the wedge-shaped solid body to the automatic pinsetter machine with one or more nuts and bolts.

5. The system of claim 1 wherein the substantially wedge-shaped solid body is mountable to an automatic pinsetter machine by securing the wedge-shaped solid body to the automatic pinsetter machine with an adhesive.

6. A method for preventing ball return stops in automatic pinsetter machines having a pit area including a ball door, a transport band, a pin elevator, a ball cushion, and a substantially wedge-shaped apparatus comprising substantially wedge-shaped solid body shaped and configured to deflect bowling pins away from a ball return door as said bowling pins travel along a transport band and towards a pin elevator, comprising the steps of:

a.

b. selecting an optimal location to mount the said wedge-shaped apparatus for preventing ball return stops in automatic pinsetter machines, said optimal location positioned slightly above the moving surface of a transport band and between a ball door and a pin elevator; and c. mounting the said apparatus for preventing ball return stops in automatic pinsetter machines.

7. The method of claim 6 wherein the said apparatus for preventing ball return stops in automatic pinsetter machines is mounted to an automatic pinsetter machine by securing said wedge-shaped solid body with one or more nuts and bolts.

8. The method of claim 6 wherein the said apparatus for preventing ball return stops in automatic pinsetter machines is mounted to an automatic pinsetter machine by securing said wedge-shaped solid body with an adhesive.

* * * * *